US006196235B1

(12) United States Patent
Kim

(10) Patent No.: US 6,196,235 B1
(45) Date of Patent: Mar. 6, 2001

(54) PORTABLE FOLDING HAIRBRUSH

(75) Inventor: Hea Joong Kim, Kyungki-Do (KR)

(73) Assignee: Zuna Corporation, Seoul (KR)

( * ) Notice: Subject to any disclaimer, the term of this patent is extended or adjusted under 35 U.S.C. 154(b) by 0 days.

(21) Appl. No.: 09/447,057

(22) Filed: Nov. 23, 1999

(30) Foreign Application Priority Data

Dec. 30, 1998 (KR) ..... 98-27800

(51) Int. Cl.[7] ..... A45D 24/00; A45D 44/18
(52) U.S. Cl. ..... 132/148; 132/313
(58) Field of Search ..... 132/148, 313, 132/150, 159, 120, 316, 114; 15/159.1, 160, 164, 186, 187

(56) References Cited

U.S. PATENT DOCUMENTS 251,060 * 12/1881 McIntosh ..... 132/313
1,259,169 * 3/1918 Train ..... 132/313
1,390,332 * 9/1921 Bethincourt ..... 132/313
1,831,667 * 11/1931 Johnson ..... 132/313
3,167,799 * 2/1965 McKinley ..... 132/313
4,116,205 * 9/1978 Owen et al. ..... 132/313
4,211,217 * 7/1980 Gueret ..... 132/313
4,479,501 * 10/1984 Chern ..... 132/313
5,320,125 * 6/1994 Barnhart ..... 132/313
5,632,289 * 5/1997 Sharp ..... 132/116

* cited by examiner

*Primary Examiner*—John J. Wilson
*Assistant Examiner*—Robyn Kieu Doan

(57) ABSTRACT

A portable folding hairbrush includes a head rim with a plurality of guide pins regularly and internally formed along the inside edge of the head rim, a grip connected to the head rim by a hinge and is provided with a mirror on its inner portion, a flexible support bed having a plurality of guide holes and is fitted into the head rim by pivoting the guide pins into the guide holes of the head rim, a plurality of hard bristles having pressure beads at the other end of the bristles, implanted into the support bed reqularly, and held by the support bed at their lower portions, so that the hairbrush accomplishes a firm fixation of the support bed to the head rim and a smooth operation of a support bed, and has a simple structure suitable for automation of production and to be collaterally usable for massage.

2 Claims, 6 Drawing Sheets

PORTABLE FOLDING HAIRBRUSH

BACKGROUND OF THE INVENTION

1. Field of the Invention

The present invention relates to a portable folding hairbrush and more particularly, to an improved portable folding hairbrush designed to accomplish a firm fixation of the support bed to the head rim and a smooth operation of the support bed, and have a simple structure suitable for automation of production and to be collaterally usable for massage.

2. Description of the Prior Art

Various types of folding hairbrushes are known in the art. Generally, a grip of the conventional folding hairbrush is designed to be foldable, thereby allowing the hairbrush to be easy to be carried. In such a conventional folding hairbrush, a head rim of such hairbrush is provided with two opposing shafts at its inside edge while the flexible and rectangular support bed of the hairbrush, having bristles, and provided with two holding pipes at the corresponding positions of its outside edge. To connect the support bed to the head rim, two shafts of the head rim are individually inserted into an associated holding pipe of the support bed.

As a result, when the grip is fully folded or unfolded, the support bed is able to be in concave position or in convex postition and simultaneously, the bristles held on the support bed are able to rise or fall for allowing the grip of the hairbrush to be folded completely at an angle of 180°.

However, such a conventional folding hairbrush can be just a simple brushing tool only with the benefit as a portable hairbrush. The support bed is fixed to the head rim only be two sides while the support bed is rectangular having four sides so that the support bed is actually not secure enogh while brushing. Furthermore, the production cost is increased, since the production process is performed by hand due to its structural complexity.

SUMMARY OF THE INVENTION

Accordingly, it is an object of the present invention to provide a portable folding hairbrush which eliminates the above problems encountered with conventional folding hairbrushes.

Another object of the present invention is to provide a portable folding hairbrush designed to accomplish a firm fixation of the support bed to the head rim and a smooth operation of the support bed, and have a simple structure suitable for automation of production and to be collaterally usable for massage.

A further object of the present invention is to provide a portable folding hairbrush including a head rim provided with a plurality of guide pins regularly and internally formed along the inside edge of the head rim, a grip connected to the head rim by a hinge and provided with a mirror on its inner portion, a flexible support bed having a plurality of guide holes projected along its edge and being fitted into the head rim by pivoting the guide holes to the guide pins of the head rim to enable the support bed to ascend and descend, and a plurality of hard bristles having pressure beads at the other end of the bristles regularly implanted into the support bed and being held by the support bed at their lower portions.

Still another object of the present invention into provide a portable folding hairbrush including a head rim provided with a plurality of holding sockets regularly and internally formed along the inside edge of the head rim, a grip connected to the head rim by a hinge and provided with a mirror on its inner portion, a flexible support bed having a plurality of support beads projected along its edge and being fitted into the head rim by pivoting the support beads into the holding sockets of the head rim to enable the support bed to ascend and descend; and a plurality of hard bristles having pressure beads at the other end of the bristles regularly implanted into the support bed and being held by the support bed at their lower portions.

Yet another object of the present invention is to provide a portable folding hairbrush which is simple in structure, inexpensive to manufacture, durable in use, and refined in appearance.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
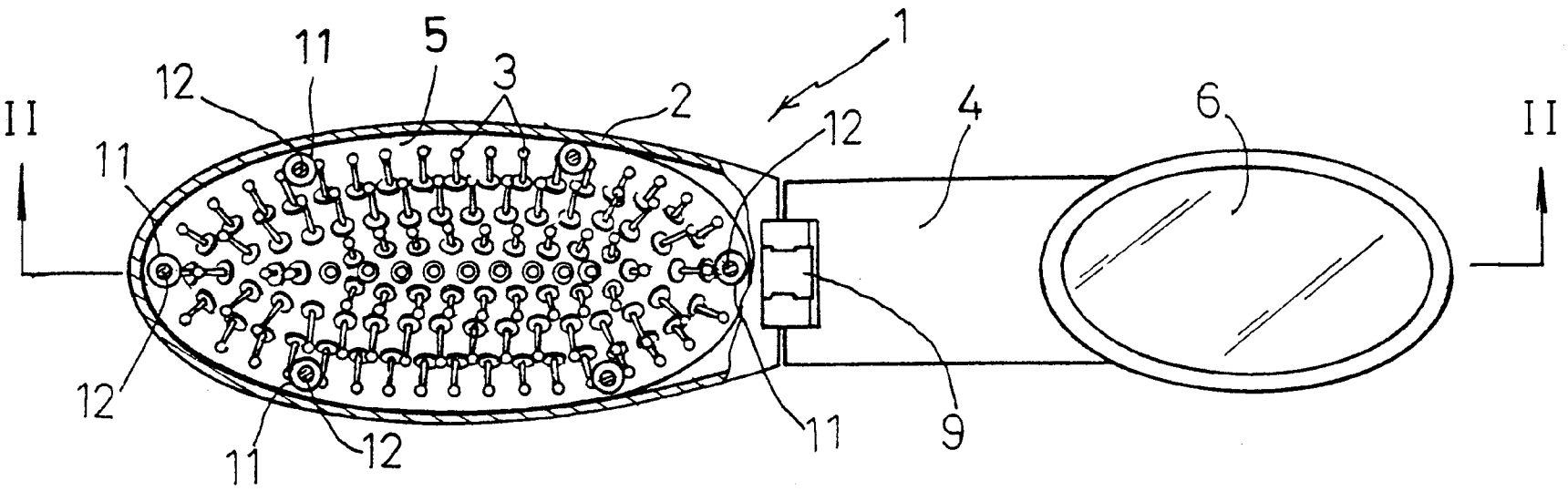
FIG. 1 is a perspective view of a portable folding hairbrush showing a portable folding hairbrush according to the first embodiment of the present invention.
Figure 2:
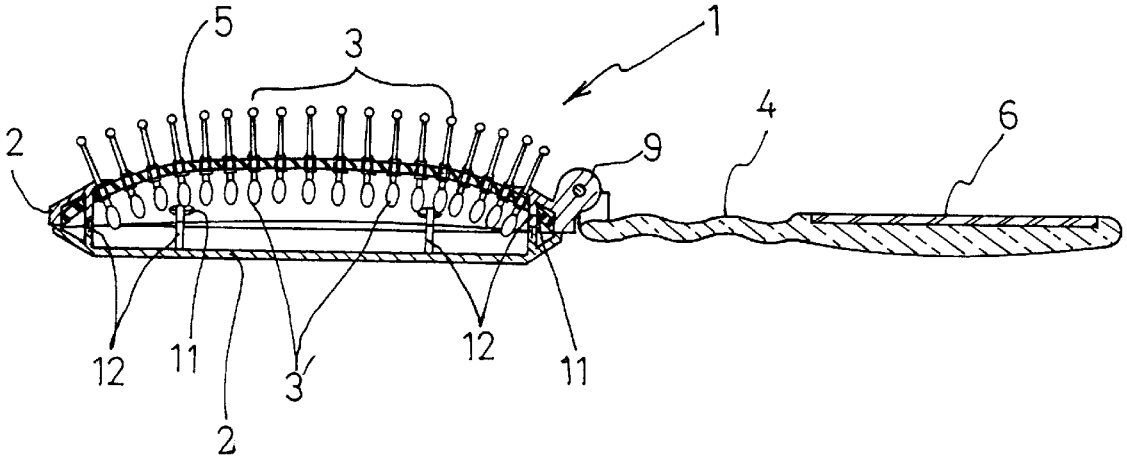
FIG. 2 is a sectional view of FIG. 1, taken along line A—A.

In FIGS. 1 to 4 a portable folding hairbrush according to the first embodiment of the present invention is shown. The portable folding hairbrush 1 includes a head rim 2 and a grip 4. The head rim 2 and the grip 4 are connected to each other by a hinge 9 so as to be foldable.

The head rim 2 is provided with a plurality of holding sockets 8. The holding sockets 8 are regularly and internally formed along the inside edge of the head rim 2. On the other hand, the grip 4 is provided with a mirror 6 on its inner portion.

A flexible support bed 5 includes a plurality of guide holes 11 and provides a plurality of guide pins 12. The guide pins 12 are regularly erected along the inside edges of the rim 2. On the other hand, the guide holes 11 are formed along the edge of the support bed 5 at the corresponding positions. When the support bed 5 is in concave position or in convex position, the bed 5 is smoothly guided by the guide pins 12 pivoted into the guide holes 11. The construction of the second embodiment is as simple as that of the first embodiment, thus allowing automation of production of the hairbrushes to be easy. The support bed 5 is preferably made of flexible material, such as rubber or synthetic resin.

A plurality of hard bristles 3, individually having a pressure bead 3' at the other end of the bristles 3, is regularly implanted into the support bed 5 and is held by the support bed 5 at their lower portions.

Figure 3:
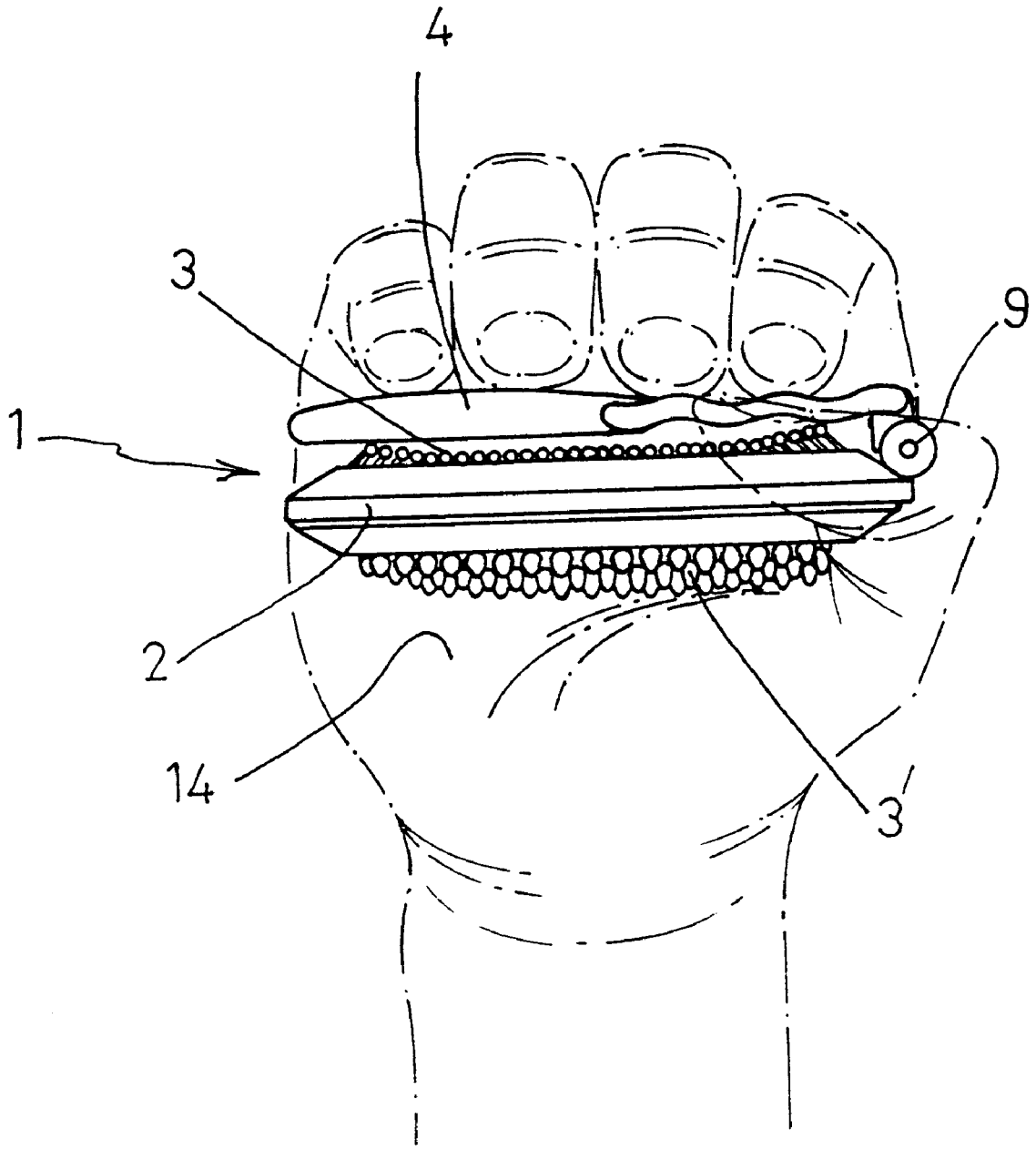
FIG. 3 is a side view of the portable folding hairbrush showing the operation of the hairbrush in a massaging position.
Figure 4:
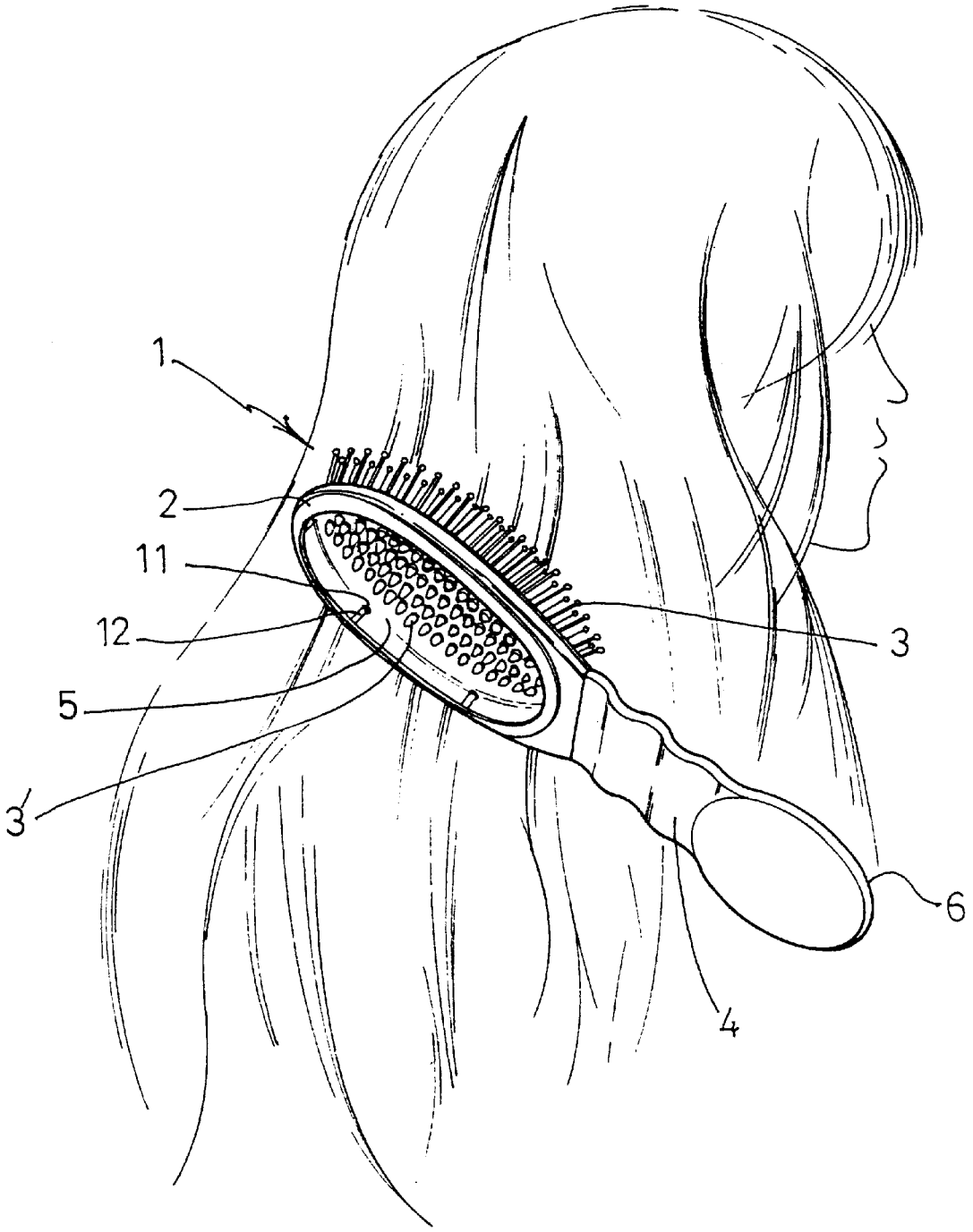
FIG. 4 is a perspective view of the portable folding hairbursh showing the operation of the hairbrush in a hair combing position.

As shown in FIGS. 3 and 4, the hairbrush according to the present invention operates as follows. In case that the hairbrush 1 is not used for brushing the hair 3, it is preferred that the support bed 5 is in concave position and the grip 4 is folded (FIG. 3). When the bristles 3 are pressed downward, the support bed 5 is in concave position and the pressure beads 3' formed on the other end of the bristles 3 are descended, thus allowing the ends of the pressure beads 3' to be arranged on an imaginary concave surface under the concave support bed 5.

In the folding action, the guide holes 11 of the support bed 5 are smoothly pivoted within the pins 12 of the head rim 2. This operation allows the pressure beads 3' to be used for massage of the human body, such as the head skin and the palm 14, and allows the grip 4 to be folded completely at an angle of 180° by an action of the hinge 9, so that the grip 4 overlaps the support bed 5 for ease of carrying.

On the other hand, in case that the hairbrush 1 is used for brushing the hair 13, it is necessary that the grip 4 is unfolded and the support bed 5 is in convex position. The grip 4 is unfolded at an angle of 180° by an action of the hinge 9. When the pressure beads 3' are pressed upward, the support bed 5 is in convex position so that the bristles 3 are ascended. Therefore, the tops of the bristles 3 are arranged on an imaginary convex surface over the convex support bed 5.

In the process of such an unfolding action, the guide holes 11 of the support bed 5 are smoothly pivoted within the pins 12 of the head rim 2. This operation allows the bristles 3 to be ready for brushing the hair 13 as shown in FIG. 4.

Figure 5:
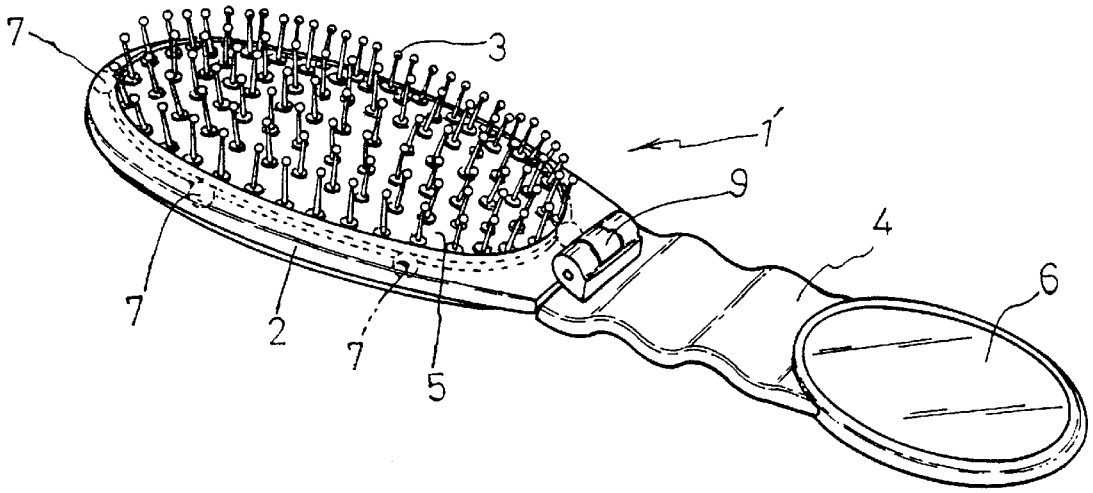
FIG. 5 is a perspective view, of the portable folding hairbrush according to the second embodiment of the present invention.
Figure 6:
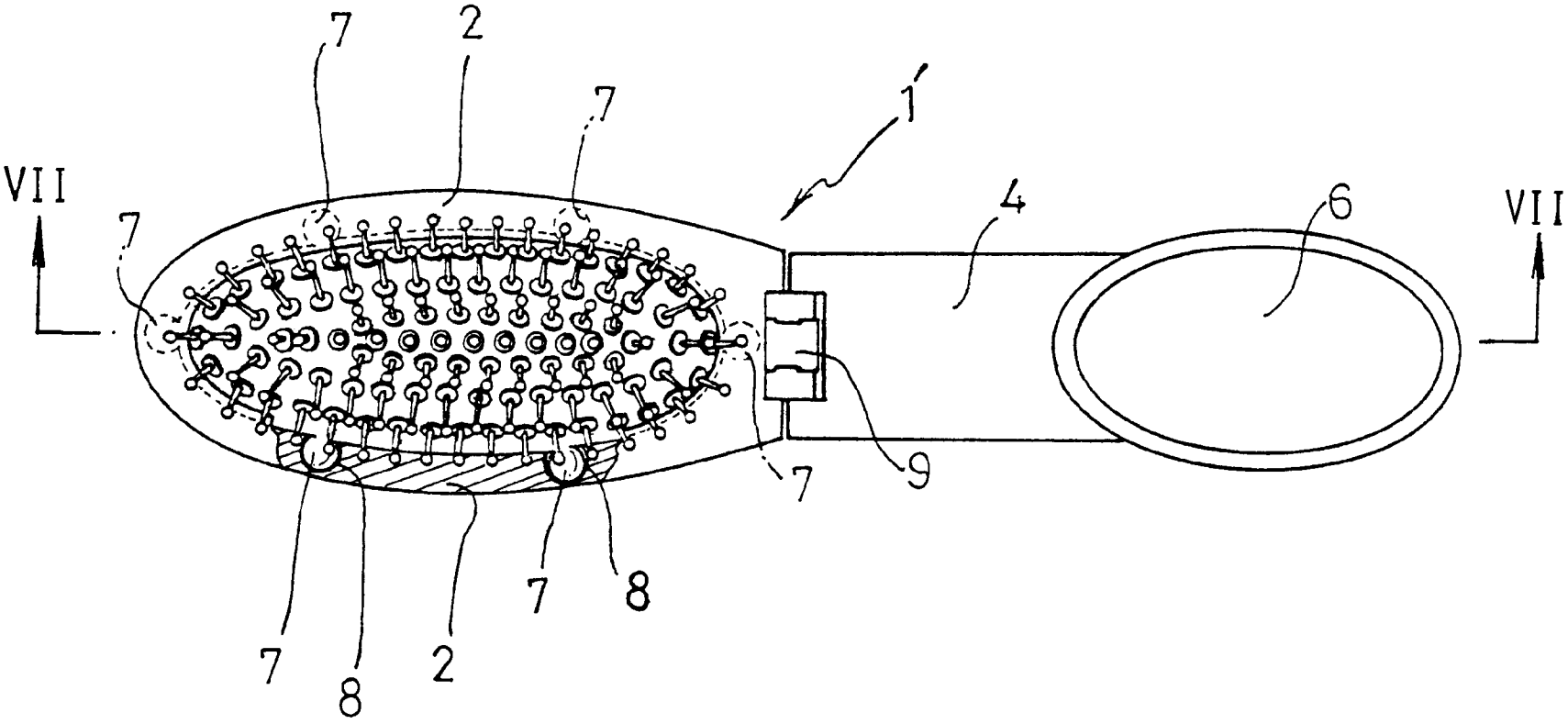
FIG. 6 is a top plan view of the portable folding hairbrush according to the second embodiment of the present invention.
Figure 7:
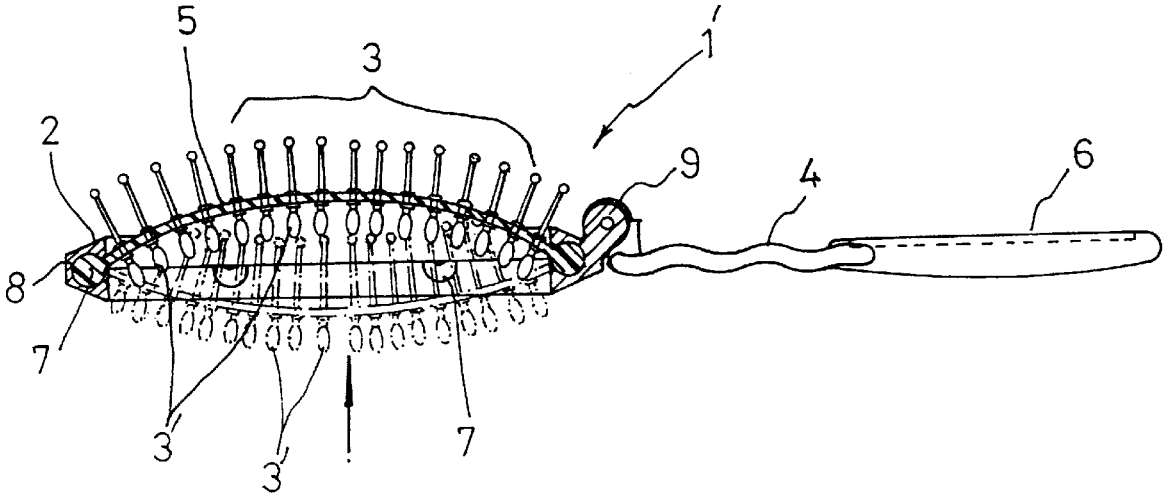
FIG. 7 is a sectional view of FIG. 6, taken along line B—B.

In FIGS. 5 to 7, a portable folding hairbrush 1' according to the second embodiment of the present invention is illustrated. In the second embodiment, many of the elements remain the same as those described for the first embodiment. Therefore, description of the elements common to the first embodiment and second embodiment will be omitted for ease of description.

In the second embodiment, the guide pins 12 and the guide holes 8 of the first embodiment, are substituted with support beads 7 and holding socket 8. That is, the flexible support bed 5, having a plurality of support beads 7 projected along its edge, is fitted into the head rim 2 by pivoting the support beads 7 into the holding sockets 8 of the head rim 2. In addition, the support bed 5 is preferably made of flexible material, such as rubber of synthetic resin.

A plurality of hard bristles 3, individually having a pressure bead 3' at the other end of the bristles 3, is regularly implanted into the support bed 5 and is held by the support bed 5 at their lower portions.

According to the hairbrush of the second embodiment, the below mentioned operation is accomplished. In case that the hairbrush 1 is not used for brushing the hair, it is preferred that the support bed 5 is in concave position and the grip 4 is folded. When the bristles 3 are pressed downward, the support bed 5 is in concave position and the pressure beads 3' formed on the other end of the bristles 3 are descended, thus allowing the ends of the pressure beads 3' to be arranged on an imaginary concave surface under the concave support bed 5.

In the folding action, the support beads 7 of the support bed 5 are smoothly pivoted within the holding sockets 8 of the head rim 2. This operation allows the pressure beads 3' to be used for massage of the human body, such as the head skin and the palm 14, and allows the grip 4 to be folded completely at an angle of 180° by an action of the hinge 9, so that the grip 4 overlaps the support bed 5 for ease of carrying.

On the other hand, in case that the hairbrush 1 is used for brushing the hair 13, it is necessary that the grip 4 is unfolded and the support bed 5 is in convex position. The grip 4 is unfolded at an angle of 180° by an action of the hinge 9. When the pressure beads 3' are pressed upward, the support bed 5 is in convex position so that the bristles 3 are ascended.

Therefore, the tops of the bristles 3 are arranged on an imaginary convex surface over the convex support bed 5. In the process of such an unfolding action, the support beads 7 of the support bed 5 are smoothly pivoted within the holding sockets 8 of the head rim 2. This operation allows the bristles 3 to be ready for brushing the hair 13.

As described above, according to this invention, a portable folding hairbrush 1 designed to accomplish a firm fixation of the support bed to the head rim and a smooth operation of the support bed 5, to have a simple structure suitable for automation of production and to be collaterally usable for massage.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A portable folding hairbrush, comprising:

a head rim including an upper inside edge and a lower inside edge, a plurality of guide pins being regularly erected along its inside edges;

a grip connected to said head rim by a hinge and provided with a mirror on its inner portion;

a flexible support bed having a plurality of guide holes formed along its edge at the corresponding positions and being fitted into the head rim by pivoting the guide holes to the guide pins of the head rim to enable the support bed to ascend and descend; and a plurality of hard bristles having pressure beads at the other end of the bristles, said bristles being regularly implanted into the support bed and being held by the support bed at their lower portions, whereby the portable folding hairbrush smoothly operatates and has a double functions as a comb and a massage device.

2. A portable folding hairbrush, comprising:

a head rim provided with a plurality of holding sockets, the holding sockets being regularly and internally formed along an inside edge of said head rim;

a grip connected to said head rim by a hinge and provided with a mirror on its inner portion;

a flexible support bed having a plurality of support beads projected along its edge and being fitted into said head rim by pivoting the support beads into the holding sockets of of the head rim; and a plurality of hard bristles having pressure beads at the other end of the bristles, said bristles being regularly implanted into the support bed and being held by the support bed at their lower portions, whereby the portable folding hairbrush smoothly operatates and has a double functions as a comb and a massage device.

* * * * *